US007686292B2

(12) United States Patent
Tanaka

(10) Patent No.: US 7,686,292 B2
(45) Date of Patent: Mar. 30, 2010

(54) SHEET FEEDING DEVICE AND IMAGE FORMING APPARATUS

(75) Inventor: Manabu Tanaka, Osaka (JP)

(73) Assignee: Kyocera Mita Corporation (JP)

( * ) Notice: Subject to any disclaimer, the term of this patent is extended or adjusted under 35 U.S.C. 154(b) by 253 days.

(21) Appl. No.: 11/367,932

(22) Filed: Mar. 3, 2006

(65) Prior Publication Data

US 2006/0197276 A1 Sep. 7, 2006

(30) Foreign Application Priority Data

Mar. 7, 2005 (JP) ..... 2005-061822

(51) Int. Cl.
*B65H 3/06* (2006.01)

(52) U.S. Cl. ..... 271/117; 271/126

(58) Field of Classification Search ..... 271/117, 271/118, 121, 124, 125
See application file for complete search history.

(56) References Cited

U.S. PATENT DOCUMENTS 5,863,036 A * 1/1999 Tanaka et al. ..... 271/10.11
6,070,867 A * 6/2000 Tsurumi et al. ..... 271/114
6,485,015 B2 * 11/2002 Yen et al. ..... 271/121

FOREIGN PATENT DOCUMENTS

| | | |
|---|---|---|
| JP | 7-14271 | 1/1995 |
| JP | 2614256 | 2/1997 |
| JP | 11-139630 | 5/1999 |
| JP | 2001-106363 | 4/2001 |

* cited by examiner

*Primary Examiner*—Patrick H Mackey
*Assistant Examiner*—Michael C McCullough
(74) *Attorney, Agent, or Firm*—Gerald E. Hespos; Anthony J. Casella

(57) ABSTRACT

A sheet feeder (20) includes a tray (30) for receiving a recording sheet (P). A feed roller (41) is disposed above the tray (30) and feeds the sheet (P). A bottom plate (50) is at a downstream end of the tray (30) and moves up and down for pressingly contacting a leading end of the sheet (P) with the roller (41). A position changer (60) moves the bottom plate (50) between a first position (S1) where the bottom plate (50) contacts the roller (41), and a second position (S2) where the bottom plate (50) is spaced from the roller (41). An elevating mechanism (70) moves the bottom plate (50) set to the second position up and down each time the sheet (P) is fed and brings the leading end of the sheet (P) into contact with the roller (41) when the bottom plate (50) is moved.

14 Claims, 6 Drawing Sheets

SHEET FEEDING DEVICE AND IMAGE FORMING APPARATUS

BACKGROUND OF THE INVENTION

1. Field of the Invention

The present invention relates to image forming apparatuses such as a copying machine, a facsimile machine, and a printer, as well as to a sheet feeding device for use in the image forming apparatuses.

2. Description of the Related Art

Heretofore, there have been known sheet feeders as disclosed in Japanese Examined Utility Model Publication No. 07-14271 and Japanese Patent No. 2614256 for use in an image forming apparatus. The sheet feeders are used for a so-called manual tray. Normally, sheet cassettes each adapted to accommodate a plurality of recording sheets of a predetermined size are detachably mounted on a main body of an image forming apparatus so that the recording sheets of the predetermined size e.g. A4 format or B5 format, which are accommodated in the respective sheet cassettes, are automatically fed to a transferring section. In the case where the sheet cassettes do not accommodate the recording sheets to be fed to the transferring section, a manual tray is used. In use of the manual tray, a user directly places a recording sheet or sheets to be fed to the transferring section on the manual tray without using the sheet cassettes.

The sheet feeders recited in the above publications are designed on a premise that a plurality of recording sheets are placed on the manual tray. Accordingly, although the sheet feeders are efficiently operable in a case that a plurality of recording sheets are placed on the manual tray, the sheet feeders are sometimes inoperable in a case that a single sheet to be fed is placed on the manual tray. In particular, it is often the case that a single recording sheet to be fed from the manual tray has a larger or a smaller thickness as compared with an ordinary recording sheet of the predetermined format size. Accordingly, it is difficult for the conventional sheet feeder to securely feed the single recording sheet having such a larger or smaller thickness to the transferring section.

SUMMARY OF THE INVENTION

In view of the above problems residing in the prior art, it is an object of the present invention to provide a sheet feeding device, for use with a manual tray, which enables to securely feed a recording sheet both in a case that a plurality of recording sheets are placed on a manual tray and a case that a single recording sheet is placed on the manual tray, and an image forming apparatus provided with the sheet feeding device.

To achieve the object of the invention, a sheet feeding device for feeding a recording sheet to a sheet transport path comprises: a sheet feeding tray for placing a recording sheet to be fed; a feed roller, disposed above the sheet feeding tray as opposed thereto, for feeding the recording sheet to a sheet transport path by a driving rotation thereof about a rotation axis thereof extending in a widthwise direction of the recording sheet; a pressing member, disposed at a downstream end of the sheet feeding tray in a sheet transport direction, the pressing member being movable up and down for pressingly contacting a leading end of the recording sheet in the sheet transport direction with the feed roller; a position changer for changing over a position of the pressing member between a first position where the pressing member comes into contact with the feed roller or is made close to the feed roller, and a second position where the pressing member is kept away from the feed roller by a certain clearance; and an elevating mechanism for moving the pressing member set to the second position up and down each time the recording sheet is fed, and for bringing the leading end of the recording sheet into contact with the feed roller when the pressing member is moved upward.

Another aspect of the invention is directed to an image forming apparatus comprising: an apparatus main body having a transferring section for transferring an image on a recording sheet; and a sheet feeding device for feeding a recording sheet toward the transferring section along a sheet transport path. The sheet feeding device has the aforementioned construction.

With the above constructions, in automatically feeding recording sheets of a stack placed on the sheet feeding tray one by one, the position changer is operated to set the pressing member to the second position. When the sheet feeding device is operated to feed the recording sheet in this state, first, the feed roller is drivingly rotated, and the pressing member is moved up and down by driving the elevating mechanism. When the pressing member is moved upward by driving the elevating mechanism, the uppermost recording sheet of the sheet stack comes into contact with the rotating feed roller. Accordingly, the uppermost recording sheet is separated from the rest of the sheet stack, and fed by the feed roller. In synchronism with the feeding operation, the pressing member is moved downward by driving the elevating mechanism. Thereby, a recording sheet to be fed next is separated from the feed roller, which enables to prevent a so called "multiple sheet feeding" such as feeding of a next recording sheet during the feeding of the uppermost recording sheet or immediately after the feeding of the uppermost recording sheet.

Making the movement of the pressing member by the elevating mechanism synchronous, for instance, with a transferring operation in the transferring section of the image forming apparatus enables to feed the sheet stack placed on the sheet feeding tray one by one to the transferring section as timed with a transferring operation in the transferring section. This allows the successive transferring operations for the respective recording sheets.

On the other hand, in placing a single recording sheet on the sheet feeding tray to perform a transferring operation for the recording sheet, the position changer is operated to set the pressing member to the first position. When the pressing member is set to the first position, the pressing member is kept in contact with the feed roller or is made close to the feed roller. Accordingly, a leading end of the recording sheet placed on the sheet feeding tray is immediately fed to a nip portion where the feed roller and the pressing member come into contact with each other. With this arrangement, even if the recording sheet having a thickness other than that of an ordinary recording sheet of a predetermined format size is placed on the sheet feeding tray, the recording sheet is readily and securely fed by the rotation of the feed roller.

As mentioned above, in feeding a single recording sheet, the pressing member is set to the first position, and in feeding the recording sheets of the stack one by one, the pressing member is set to the second position. Thus, changing over the position of the pressing member depending on the number of the recording sheets to be fed from the sheet feeding tray enables to properly feed the recording sheet toward the transferring section, irrespective of the condition as to whether the recording sheet placed on the sheet feeding tray is single or multiple.

These and other objects, features and advantages of the present invention will become more apparent upon reading of the following detailed description along with the accompanying drawings.

BRIEF DESCRIPTION OF THE DRAWINGS

FIGS. 2A and 2B are perspective views showing an embodiment of a manual sheet feeder as an example of the sheet feeding device, wherein FIG. 2A shows a state that a manual tray is set to an opened position, and FIG. 2B shows a state that the manual tray is set to a closed position.

FIGS. 5A and 5B are cross-sectional views of the bottom plate taken the line V-V in FIG. 4, wherein FIG. 5A shows a state that a first projection is set to an upper position where a blocking projection is set to a contact position, and FIG. 5B shows a state that the first projection is set to a lower position where the blocking projection is set to a release position.

FIGS. 6A, 6B, and 6C are cross-sectional views of the manual sheet feeder taken along the line VI-VI in FIG. 4 for describing an operation of the manual sheet feeder in the case where a sheet stack is placed on the manual tray in a state that the blocking projection is set to the contact position, namely, a state that the first projection is set to the upper position, wherein FIG. 6A shows a state that the sheet stack is not placed on the bottom plate set to the upper position, FIG. 6B shows a state that the sheet stack is placed on the bottom plate set to the second position, and FIG. 6C shows a state that a recording sheet is to be fed out of the sheet stack placed on the bottom plate set to the second position.

DETAILED DESCRIPTION OF THE PREFERRED EMBODIMENTS

Figure 1:
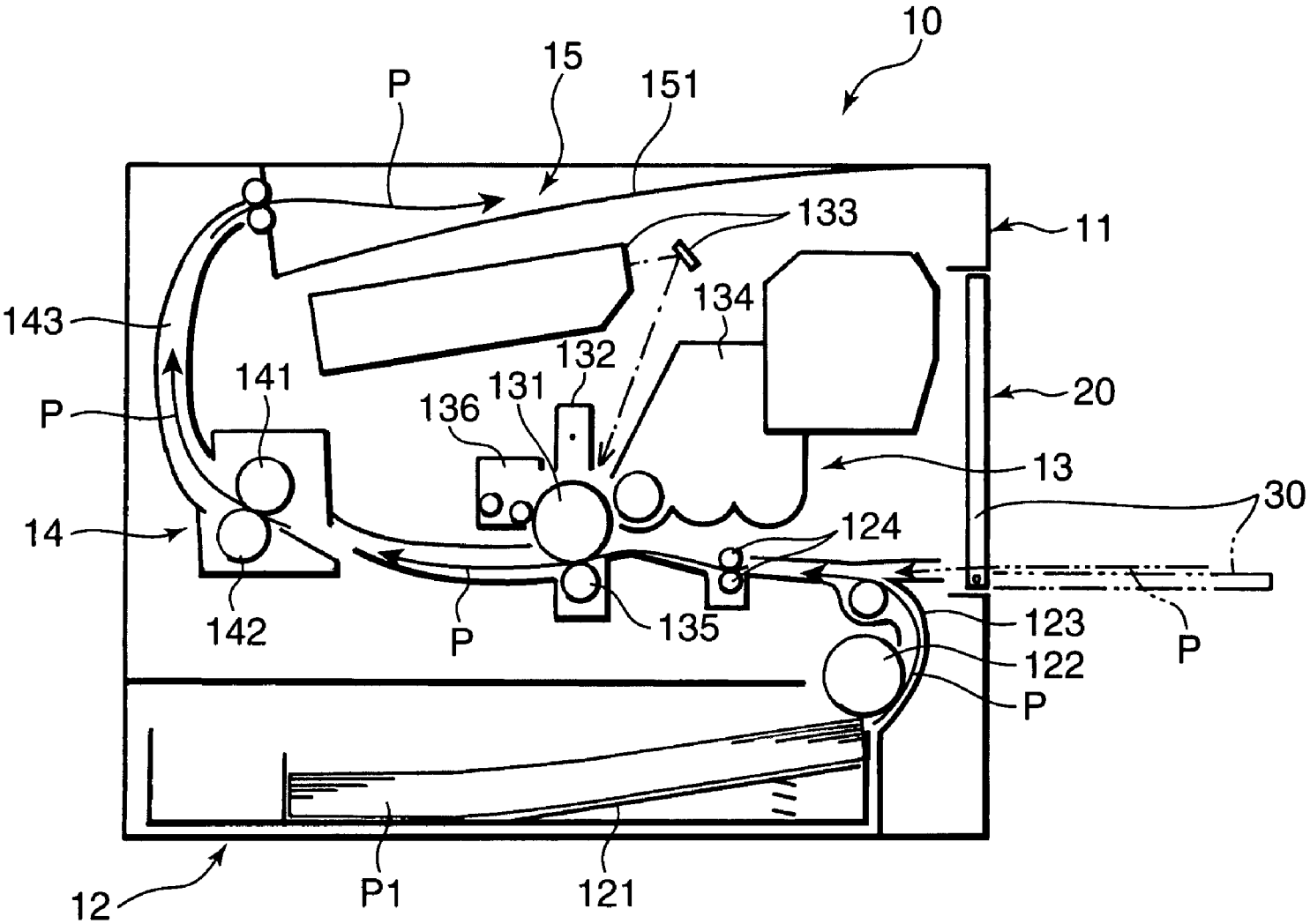
FIG. 1 is a cross-sectional side view showing an internal construction of a printer to which a sheet feeding device of an embodiment of the invention is applied.

In the following, an embodiment of the invention is described referring to the drawings. FIG. 1 is a cross-sectional side view showing an internal construction of a printer to which a sheet feeding device in accordance with an embodiment of the invention is applied. As shown in FIG. 1, the printer 10, an example of an image forming apparatus, is provided with an apparatus main body 11. The apparatus main body 11 includes, as internal components, a sheet storing section 12 for storing a stack P1 of recording sheets to be printed therein; a transferring section 13 for transferring an image onto the recording sheet P which is dispensed out of the sheet stack P1 stored in the sheet storing section 12; and a fixing section 14 for fixing the transferred image on the recording sheet P. The printer 10 also has a sheet discharging section 15, on a top part of the apparatus main body 11, for discharging the recording sheet P after the image fixation in the fixing section 14, and a manual sheet feeder 20, which is provided on a right wall of the apparatus main body 11 in FIG. 1, so that the recording sheet P manually placed by a user can be fed. The manual sheet feeder 20 serves as a sheet feeding device of the invention.

The sheet storing section 12 includes a certain number of sheet cassettes each of which is detachably mounted to the apparatus main body 11. In this embodiment, the sheet storing section 12 has a single sheet cassette 121. A pickup roller 122 is provided at a downstream end of the sheet cassette 121, i.e. on the right side in FIG. 1, for dispensing a recording sheet P out of the sheet stack P1. The recording sheet P dispensed from the sheet cassette 121 by driving of the pickup roller 122 is fed to the transferring section 13 along a sheet transport path 123 and by way of a pair of registration rollers 124 provided at a downstream end of the sheet transport path 123.

The transferring section 13 is adapted to transfer an image onto the recording sheet P based on image information transmitted from a computer or a like device. The transferring section 13 includes a photosensitive drum 131 which is rotatable about a rotational axis thereof extending in a widthwise direction of the recording sheet P i.e. a direction orthogonal to the plane of FIG. 1. The transferring section 13 also includes, in the periphery of the photosensitive drum 131, a charger 132, an exposure device 133, a developing device 134, a transfer roller 135, and a cleaning device 136 in this order from a position immediately above the photosensitive drum 131 in the clockwise direction in FIG. 1.

The photosensitive drum 131 is adapted to form an electrostatic latent image, and a toner image based on the electrostatic latent image on the surface thereof, and is an amorphous silicon photosensitive drum formed with an amorphous silicon layer on the surface thereof.

The charger 132 is adapted to uniformly generate an electric charge on the surface of the photosensitive drum 131 which is rotated in the clockwise direction about the rotational axis thereof. In the example of FIG. 1, the charger 132 is a charger for applying an electric charge to the surface of the photosensitive drum 131 by corona discharge. Alternatively, a contact charging type charging roller for applying an electric charge to the surface of the photosensitive drum 131 while being rotated in contact with the surface thereof may be used, in place of the charger 132.

The exposure device 133 is adapted to project a laser beam, whose intensity is controlled based on the image information transmitted from the external device such as the computer, onto the surface of the rotating photosensitive drum 131, and to form an electrostatic latent image on the surface of the photosensitive drum 131 by removal of the electric charge on the area where the laser beam has been projected.

The developing device 134 is adapted to form a toner image on the surface of the photosensitive drum 131 by supplying toner to the surface of the photosensitive drum 131 and attracting the toner onto the area of the surface of the photosensitive drum 131 where the electrostatic latent image has been formed.

The transfer roller 135 is adapted to transfer the toner image, which is formed on the surface of the photosensitive drum 131 and carries a positive electric charge, onto the recording sheet P being transported to the position immediately below the photosensitive drum 131, and to apply, onto the recording sheet P, a negative electric charge whose polarity is opposite to the polarity of the electric charge of the toner image.

In this arrangement, when the recording sheet P reaches the position immediately below the photosensitive drum 131, the recording sheet P is pressingly held by the transfer roller 135 and the photosensitive drum 131. While the recording sheet P is pressingly held, the positively-charged toner image on the surface of the photosensitive drum 131 is attracted to the negatively-charged recording sheet P, whereby the toner image is transferred onto the recording sheet P.

The cleaning device 136 is adapted to clean the surface of the photosensitive drum 131 by removing toner residues from the surface of the photosensitive drum 131 after the transferring operation. The surface of the photosensitive drum 131 after the cleaning operation by the cleaning device 136 opposes the charger 132 again for a next image formation.

The fixing section 14 is adapted to fix the toner image transferred to the recording sheet P in the transferring section 13 by heat application. The fixing section 14 includes a heater roller 141 provided with an internal thermal heater, and a pressure roller 142 which is disposed below the heater roller 141 in pressing contact therewith. After the transferring operation, the recording sheet P passes a nip portion defined by the heater roller 141 which drivingly rotates clockwise about a rotational axis thereof, and the pressure roller 142 which is drivingly rotated counterclockwise about a rotational axis thereof, whereby the toner image is fixed onto the recording sheet by application of the heat from the heater roller 141. After the fixing operation, the recording sheet P is discharged onto the sheet discharging section 15 along a sheet discharging path 143.

The sheet discharging section 15 is defined by forming the top part of the apparatus main body 11 into a recess. A sheet discharging tray 151 is defined on a bottom portion of the recess to receive the recording sheet P which is discharged out of the apparatus main body 11.

Figure 2A:
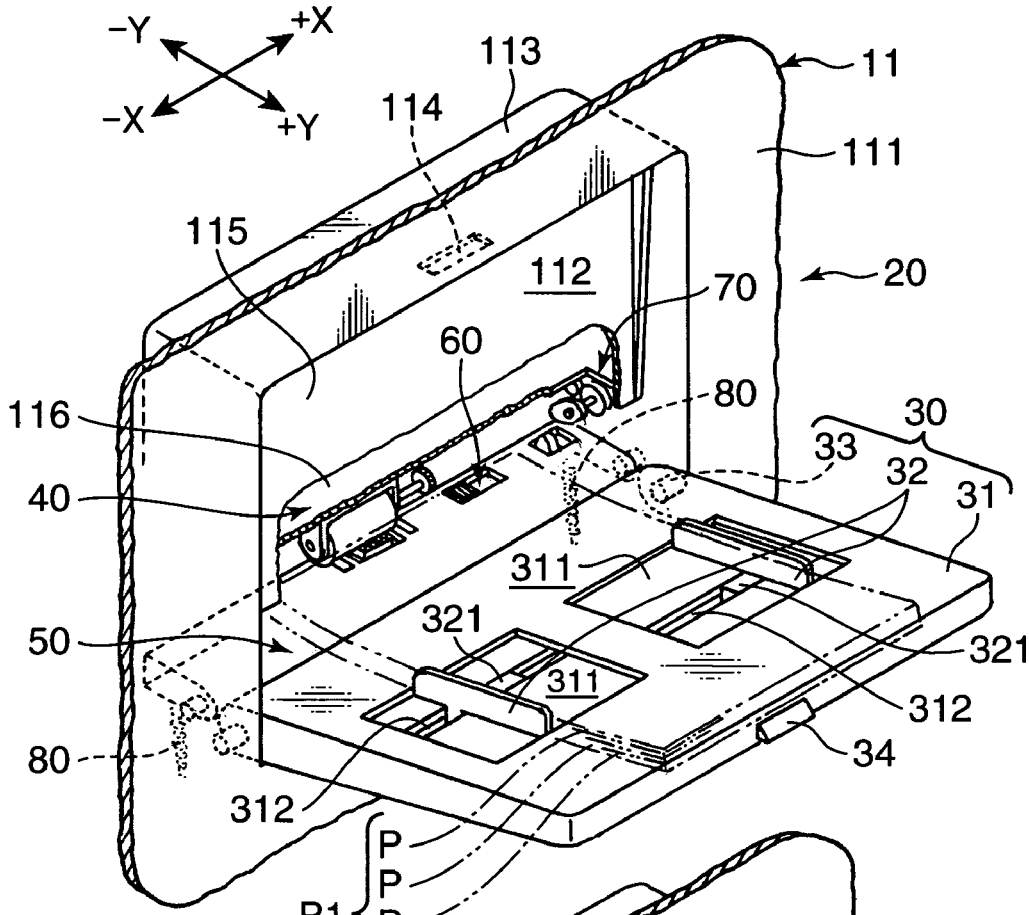
Figure 2B:
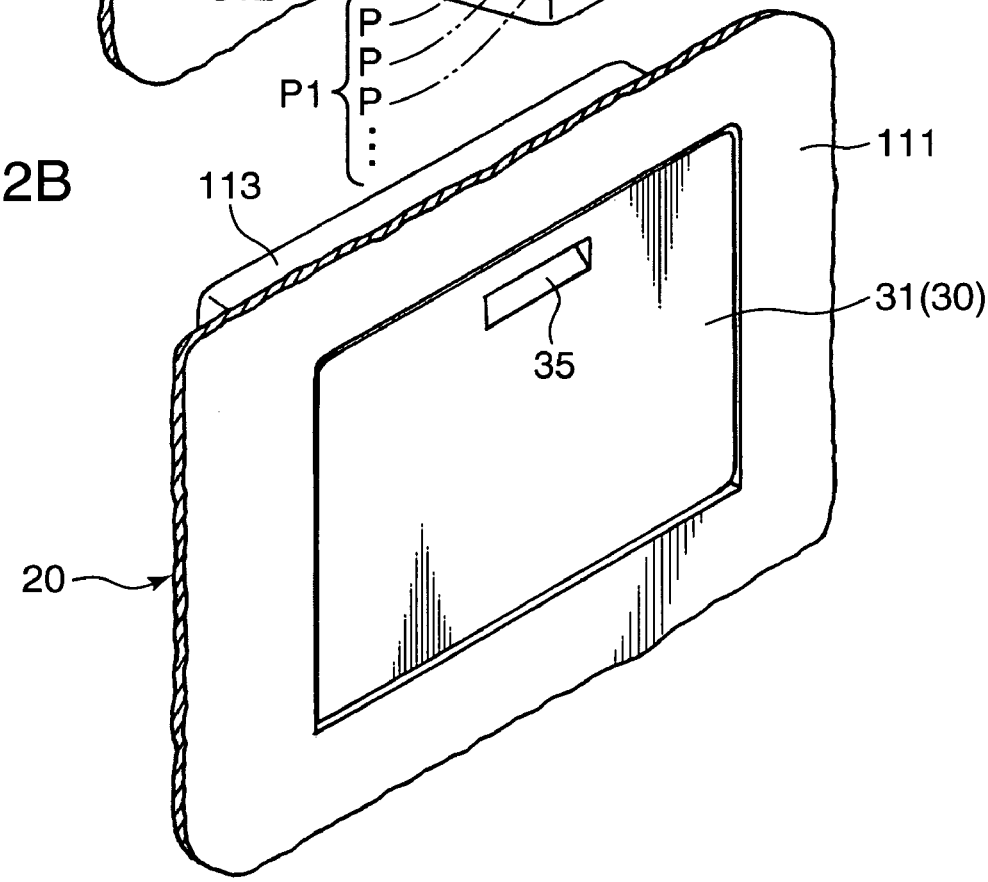

FIGS. 2A and 2B are perspective views showing an arrangement of the manual sheet feeder 20. FIG. 2A shows a state that a manual tray 30 is set to an opened position, and FIG. 2B shows a state that the manual tray 30 is set to a closed position. In FIGS. 2A and 2B, X-X directions are referred to as widthwise directions of the printer 10, Y-Y directions are referred to as longitudinal directions of the printer 10, and specifically, −X direction is referred to as leftward direction, +X direction is referred to as rightward direction, −Y direction is referred to as forward direction, and +Y direction is referred to as rearward direction.

As shown in FIGS. 2A and 2B, the manual sheet feeder 20 essentially includes: the manual tray 30, which serves as a sheet feeding tray, and openably closes a rectangular-shaped tray opening 112 formed in a rear wall 111 of the apparatus main body 11; a sheet feeding mechanism 40, which is provided at a position slightly above the manual tray 30 and inside the tray opening 112; a bottom plate 50, which serves as a pressing member, and is pivotally connected to a downstream end of the manual tray 30, as opposed to the sheet feeding mechanism 40 at a lower side thereof; a position changer 60 for changing over the position of the bottom plate 50 between a first position S1 corresponding to an upper position, and a second position S2 (see FIG. 6A through 6C) corresponding to a lower position; an elevating mechanism 70 for pivotally moving the bottom plate 50 set to the second position S2 by the position changer 60 up and down each time the recording sheet P is fed; and coil springs 80, which serves as urging members, and are adapted to urge the bottom plate 50 upward.

The manual tray 30 includes a planar-shaped tray main body 31, a pair of width aligners 32 which is attached to the tray main body 31 in the widthwise directions, and a pair of pivot pins 33 which are provided at widthwise opposite ends on a base end of the tray main body 31 and extend toward each other in the widthwise directions. The width aligners 32 are adapted to align the respective recording sheets P in the widthwise directions thereof after the sheet stack P1 placed on the tray main body 31 has its widthwise central position aligned.

The tray main body 31 has an internal hollow portion, and is formed with a pair of receiving recesses 311 in an upper surface of the tray main body 31 in FIG. 2A. The receiving recesses 311 are formed spaced away from each other in the widthwise directions, with each one thereof having a rectangular shape in top plan view with a small depth. The width aligners 32 extend in a sheet feeding direction in the receiving recesses 311, respectively, in such a manner that the width aligners 32 are movable toward and away from each other in the widthwise directions. Prismatic guide tabs 321 extend in the widthwise directions from bottom surfaces of the width aligners 32, respectively. Guiding slots 312 extend in the widthwise directions from bottom portions of the receiving recesses 311, respectively, at positions displaced from each other in the sheet feeding direction. When the guide tabs 321 are slidably moved along the respective corresponding widthwise extending guiding slots 312, the width aligners 32 are movable toward and away from each other in the widthwise directions while being guided along the guiding slots 312, respectively.

The pivot pins 33 extend in the widthwise directions toward each other from the base ends (namely, at the forward side in FIG. 2A) of lateral ends of the tray main body 31, respectively. The pivot pins 33 are attached to lower portions of side walls of a four-sided frame member 113 for defining the tray opening 112. With this arrangement, the manual tray 30 is changeable to an opened position shown in FIG. 2A where the manual tray 30 is withdrawn from the tray opening 112, and to a closed position shown in FIG. 2B where the tray opening 112 is closed, by pivotally rotating the manual tray 30 about axes of the pivot pins 33.

Also, a retractable locking pawl 34 is provided on a top portion of the tray main body 30, namely, on a rear end of the tray main body 30 in FIG. 2A. A locking recess 114 engageable with the locking pawl 34 is formed in a top wall of the frame member 113. Engagement of the locking pawl 34 in the locking recess 114 in a state that the manual tray 30 is held at the closed position secures the closed state of the manual tray 30.

As shown in FIG. 2B, a handle recess 35 is formed in an outer surface of the tray main body 31. The locking pawl 34 which is normally protruded outside by an urging force of an urging member (not shown) is retracted when a user puts his or her finger(s) in the handle recess 35 and manipulates an unillustrated lever.

Also, a partition wall 115 extends between the side walls of the frame member 113 within the tray opening 112, namely, at a position on the forward side in FIG. 2A. The partition wall 115 opposes the manual tray 30 in the closed position, and extends downward from the top wall of the frame member 113, with a free end formed on a lower end thereof. The partition wall 115 has a horizontal plate 116 which is formed between the side walls of the frame member 113 and extends in the forward direction from the lower end of the partition wall 115.

Figure 3:
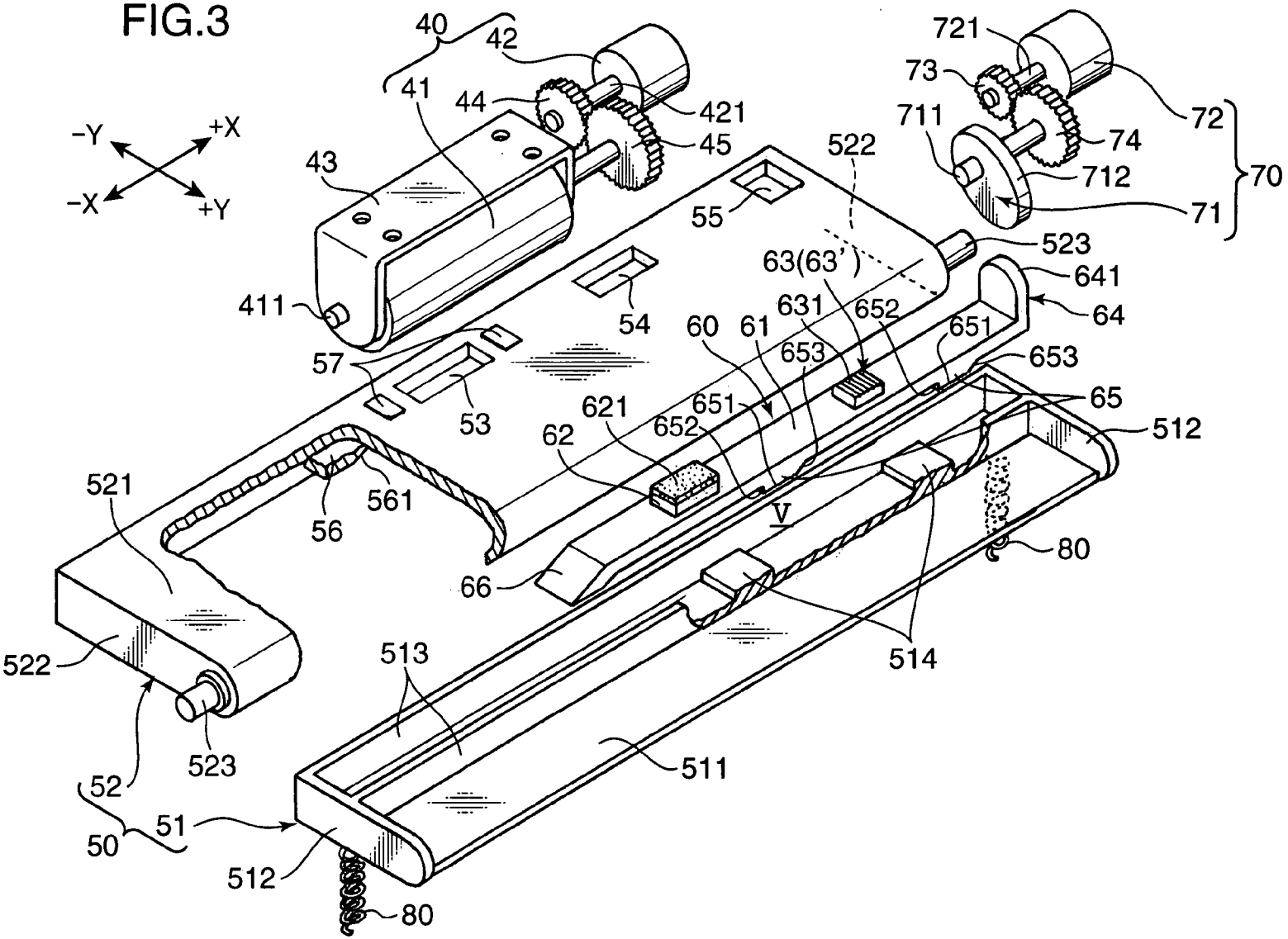
FIG. 3 is a partially cutaway exploded perspective view of the manual sheet feeder to describe a sheet feeding mechanism, a bottom plate, a position changer, and an elevating mechanism.
Figure 4:
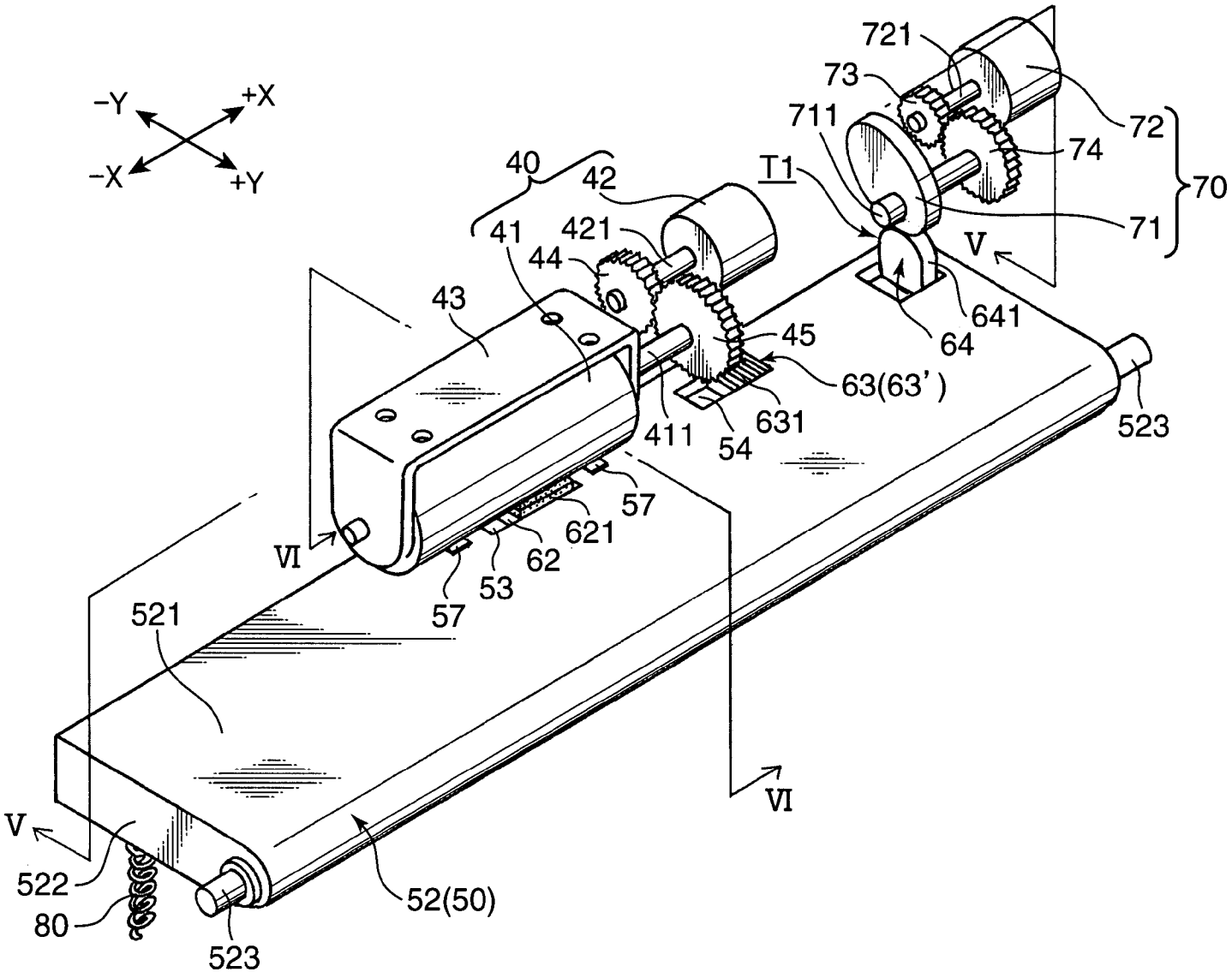
FIG. 4 is a perspective view showing an assembled state of the manual sheet feeder shown in FIG. 3.

FIG. 3 is a partially cutaway exploded perspective view of the manual sheet feeder 20 for describing the sheet feeding mechanism 40, the bottom plate 50, the position changer 60, and the elevating mechanism 70. FIG. 4 is a perspective view showing an assembled state of the manual sheet feeder 20 shown in FIG. 3. Similarly to FIGS. 2A and 2B, X-X directions are referred to as widthwise directions of the printer 10, Y-Y directions are referred to as longitudinal directions of the printer 10, and specifically, −X direction is referred to as leftward direction, +X direction is referred to as rightward direction, −Y direction is referred to as forward direction, and +Y direction is referred to as rearward direction.

As shown in FIG. 3, the sheet feeding mechanism 40 includes a feed roller 41 which is mounted on a bracket 43 that is secured to the horizontal plate 116 (see FIG. 2A) of the frame member 113, and a feed motor 42 for driving the feed roller 41. The feed roller 41 is adapted to feed a downstream end of the recording sheet P placed on the bottom plate 50 in the forward direction. The feed roller 41 has a roller shaft 411 which extends through the feed roller 41 and is concentrically rotatable therewith. The roller shaft 411 is rotatably supported on the bracket 43, which is fixed substantially to a widthwise central position on the lower surface of the horizontal plate 116, and has two widthwise ends extending downwardly.

The feed motor 42 is mounted at an appropriate position on the right side of the bracket 43, with a drive shaft 421 extending through the feed motor 42 in the widthwise directions. A drive gear 44 is concentrically attached to the drive shaft 421 to be rotatable with the drive shaft 421. A driven gear 45 in mesh with the drive gear 44 is concentrically mounted on the roller shaft 411 to be rotatable with the roller shaft 411. With this arrangement, driving of the feed motor 42 is transmitted to the feed roller 41 via the drive shaft 421, the drive gear 44, the driven gear 45, and the roller shaft 411. Thus, the feed roller 41 is drivingly rotated.

The bottom plate 50 is continued to the downstream end of the manual tray 30, and serves as a part of the manual sheet feeder 20 for conducting a sheet feeding operation. The bottom plate 50 includes an elongated lower wall portion 51 extending in the widthwise directions, and an upper wall portion 52 to be placed over the lower wall portion 51. The lower wall portion 51 has a planar main body 511, and a pair of side walls 512 which are formed at the widthwise ends of the planar main body 511, respectively, and extend in the longitudinal directions.

A pair of widthwise extending ribs 513 are formed spaced away from each other in the sheet feeding direction at the forward position on the upper surface of the planar main body 511. A mounting space V is defined by the pair of ribs 513 to mount the position changer 60 therein. A predetermined number (in this embodiment, two) of anchor projections 514 are provided on the planar main body 511 at appropriate positions between the ribs 513 to serve as a part of the position changer 60.

The upper wall portion 52 includes a planar main body 521 opposed to the planar main body 511 of the lower wall portion 51 spaced above therefrom, a pair of side walls 522 which extend downward at the widthwise opposite ends of the planar main body 521, respectively, and correspond to the side walls 512 of the lower wall portion 51, and a pair of pivot pins or support pins 523 which extend in the widthwise directions away from each other from the side walls 522, respectively. The pivot pins 523 extend through the lower portions of the side walls of the frame member 113 (see FIG. 2A). With this arrangement, a forward end of the upper wall portion 52 is pivotally moved up and down about axes of the pivot pins 523.

A first engaging opening 53 is formed in the upper wall portion 52 at a position opposing to the feed roller 41 and the mounting space V. A second engaging opening 54 is formed in the upper wall portion 52 at a position next to the right of the first engaging opening 53 and opposing to the space between the ribs 513. A third engaging opening 55 is formed in the upper wall portion 52 at a position next to the right of the second engaging opening 54 and opposing to the space between the ribs 513. A first projection 62, a second projection 63, and a blocking projection 64 of the position changer 60, which will be described later, are engaged in the first engaging opening 53, the second engaging opening 54, and the third engaging opening 55, respectively.

An internal distance between the side walls 522 of the upper wall portion 52 is slightly large than an external distance of the side walls 512 of the lower wall portion 51. With this arrangement, covering the side walls 522 of the upper wall portion 52 over the side walls 512 of the lower wall portion 51, and fixing the upper wall portion 52 and the lower portion 51 together by fastening means such as a screw or a like member enables to assemble the bottom plate 50 as shown in FIG. 4.

Synthetic resinous sheet-like guide pads 57 having a relatively small frictional coefficient or a second frictional coefficient are attached to the widthwise ends of the first engaging opening 53 on the upper surface of the upper wall portion 52. With this arrangement, when the position changer 60 sets the bottom plate 50 to a lower position U2 (see FIG. 5B), the recording sheet P is securely and pressingly held by the feed roller 41 and the guide pads 57 in a well-balanced manner in a state that a contact pad 621 having a relatively large frictional coefficient or a first frictional coefficient is received in the first engaging opening 53. The contact pad 621 will be described later. With this arrangement, the single recording sheet P placed on the manual tray 30 is securely fed to the transferring section 13 by driving rotation of the feed roller 41.

The position changer 60 includes: an elongated switching bar or a slide bar 61 extending in the widthwise directions; the first projection 62 projecting upward from the upper surface of the switching bar 61 at a position corresponding to the first engaging opening 53; the second projection 63 projecting upward from the upper surface of the switching bar 61 at a position corresponding to the second engaging opening 54; the blocking projection 64 which projects upward at a position corresponding to the third engaging opening 55, and interferes with an eccentric cam 71 to be described later; and elevating projections 65 which project downward from the lower surface of the switching bar 61 as opposed to the anchor projections 514.

The switching bar 61 has a width slightly smaller than the internal distance between the ribs 513, and has a height or a thickness half as small as the height of the rib 513 or less. With this arrangement, the switching bar 61 is movable up and down and in sideways directions within the mounting space V.

The first projection 62, the second projection 63, and the blocking projection 64 are provided at such positions as to be engaged in the first engaging opening 53, the second engaging opening 54, and the third engaging opening 55 of the upper wall portion 52, respectively, in a state that the switching bar 61 is mounted in the mounting space V, and the upper wall portion 52 is securely placed over the lower wall portion 51. Also, the first engaging opening 53, the second engaging opening 54, and the third engaging opening 55 have lengths thereof in the widthwise directions substantially twice as long as the lengths of the first projection 62, the second projection 63, and the blocking projection 64, respectively. With this arrangement, the switching bar 61 is changeable to a contact position T1 (see FIG. 5A) where the blocking projection 64 is contacted with the eccentric cam 71 in a state that the first projection 62, the second projection 63, and the blocking projection 64 are engaged in the first engaging opening 53, the second engaging opening 54, and the third engaging opening 55 with the right ends thereof being abutted against the right walls of the corresponding openings 53, 54, 55, respectively; and to a release position T2 (see FIG. 5B) where the contact of the blocking projection 64 with the eccentric cam 71 is released, with the left ends of the first projection 62, the second projection 63, and the blocking projection 64 being abutted against the left walls of the first engaging opening 53, the second engaging opening 54, and the third engaging opening 55, respectively.

The elevating projections 65 in cooperation with the anchor projections 514 change the height of the first projection 62 between the upper position U1 (see FIG. 5A) and the lower position (see FIG. 5B), and also change the position of the blocking projection 64 between the contact position T1 and the release position T2. In this embodiment, the left-side elevating projection 65 is provided between the first projection 62 and the second projection 63, and the right-side elevating projection 65 is provided between the second projection 63 and the blocking projection 64.

The elevating projections 65 each has a flat portion 651 whose lower surface is in parallel with the switching bar 61, a vertical portion 652 formed on the left side of the flat portion 651, and an upslope 653 gradually tilted upward from the right end of the flat portion 651 in the rightward direction.

The anchor projections 514 in the mounting space V are each provided at such a position that the flat portion 651 climbs over the corresponding anchor projection 514 when the first projection 62 is set to the upper position U1 where the first projection 62 is abutted against the right wall of the first engaging opening 53, and that the anchor projection 514 is located on the right side of the upslope 653 when the first projection 62 is set to the lower position U2 where the first projection 62 is abutted against the left wall of the first engaging opening 53. With this arrangement, the switching bar 61 is shifted from the lower position U2 to the upper position U1, with the upslope 653 being guided by the anchor projection 514, by moving the second projection 63 which is abutted against the left wall of the second engaging opening 54 in the rightward direction. On the other hand, the switching bar 61 is returned to the original position i.e. to the lower position U2 by moving the second projection 63 in the leftward direction.

The terms "upper position U1" and "lower position U2" are named in view of the vertical movements of the first projection 62, and the terms "contact position T1" and "release position T2" are named in view of the widthwise movements of the blocking projection 64. Observing the movement of the position changer 60 as a whole, the upper position U1 is equivalent to the contact position T1, and the lower position U2 is equivalent to the release position T2.

The contact pad 621, which is made of an elastomeric material such as a rubber and has a larger frictional coefficient than that of the recording sheet P, is attached to the top of the first projection 62. This enables to position the bottom plate 50 to the first position S1, and to securely and pressingly hold the sheet stack P1 between the contact pad 621 and the feed roller 41 in a state that the first projection 62 is set to the upper position U1. Also, plural longitudinally extending knurled ribs 631 are formed on the top of the second projection 63 so that the second projection 63 efficiently functions as a switching lever 63' to be operable by an operator, using the slip preventing function of the knurled ribs 631. Hereinafter, the second projection 63 is called as "switching lever 63'".

Also, in the embodiment, a downslope 66 is formed at a left end of the switching bar 61. The downslope 66 is tilted downward in the leftward direction. A guide projection 56 is formed on the lower surface of the upper wall portion 52 of the bottom plate 50 at a position opposing to the downslope 66. The guide projection 56 has an upslope 561 at a right end thereof. The upslope 561 is tilted upward in the rightward direction. With this arrangement, by moving the switching lever 63' located at the right side of the switching bar 61 in the leftward direction, the contact pad 621 is forcibly moved to the lower position U2 as the downslope 66 of the switching bar 61 is guided along the upslope 561 of the guide projection 56, without using the gravitational force of the switching bar 61.

The elevating mechanism 70 is adapted to change the position of the bottom plate 50 between the first position S1 and the second position S2 by pivotally moving the bottom plate 50 up and down by way of the blocking projection 64. The elevating mechanism 70 includes the eccentric cam 71 which is provided at a lower right position of the horizontal plate 116 (see FIG. 2A) of the frame member 113, and is adapted to be brought into contact with an arcuate surface 641 of the blocking projection 64 when the switching bar 61 is set to the contact position T1, and an elevating motor 72 for drivingly rotating the eccentric cam 71 about an axis of a cam shaft 711.

A drive gear 73 is concentrically mounted on a drive shaft 721 of the elevating motor 72 to be rotatable with the drive shaft 721. A driven gear 74 in mesh with the drive gear 73 is concentrically mounted on the cam shaft 711 to be rotatable with the cam shaft 711. With this arrangement, when the elevating motor 72 is driven, the driving force of the elevating motor 72 is transmitted to the eccentric cam 71 via the drive shaft 721, the drive gear 73, the driven gear 74, and the cam shaft 711 to rotate the eccentric cam 71 with the cam shaft 711 about the axis of the cam shaft 711. The eccentric cam 71 has a substantially elliptic shape. The cam shaft 711 is integrally formed with the eccentric cam 71, and extends through a position in the vicinity of one of the focuses of the orbit of the eccentric cam 71.

The coil springs 80 are each provided in a compressed state between the lower wall portion 51 of the bottom plate 50, and the bottom wall of the frame member 113 (see FIG. 2A) to constantly urge the bottom plate 50 upward. In this embodiment, the coil springs 80 are provided to urge the bottom plate 50 at the respective widthwise ends thereof. Thereby, the bottom plate 50 is securely urged in a well-balanced manner.

With this arrangement, moving the switching projection 63' rightward, and driving the elevating motor 72 in a state that the blocking projection 64 is set to the contact position T1 (see FIG. 4) allows the eccentric cam 71 to eccentrically rotate about the axis of the cam shaft 711. Thereby, a circumferential surface 712 of the eccentric cam 71 is pressingly contacted with the arcuate surface 641 of the blocking projection 64, and the pressing contact is released, alternately. In response to the pressing and releasing operations, the bottom plate 50 is pivoted up and down about the axes of the pivot pins 523, whereby the forward end of the bottom plate 50 is pivotally moved up and down.

Figure 5A:
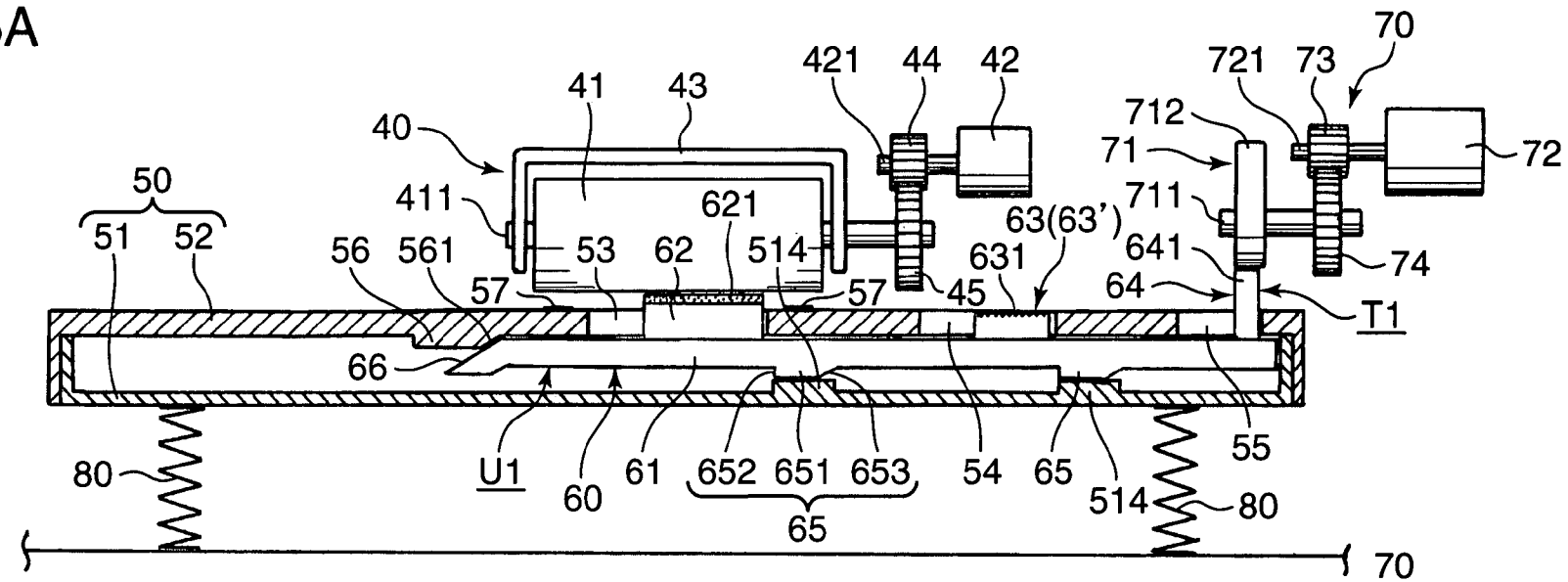
Figure 5B:
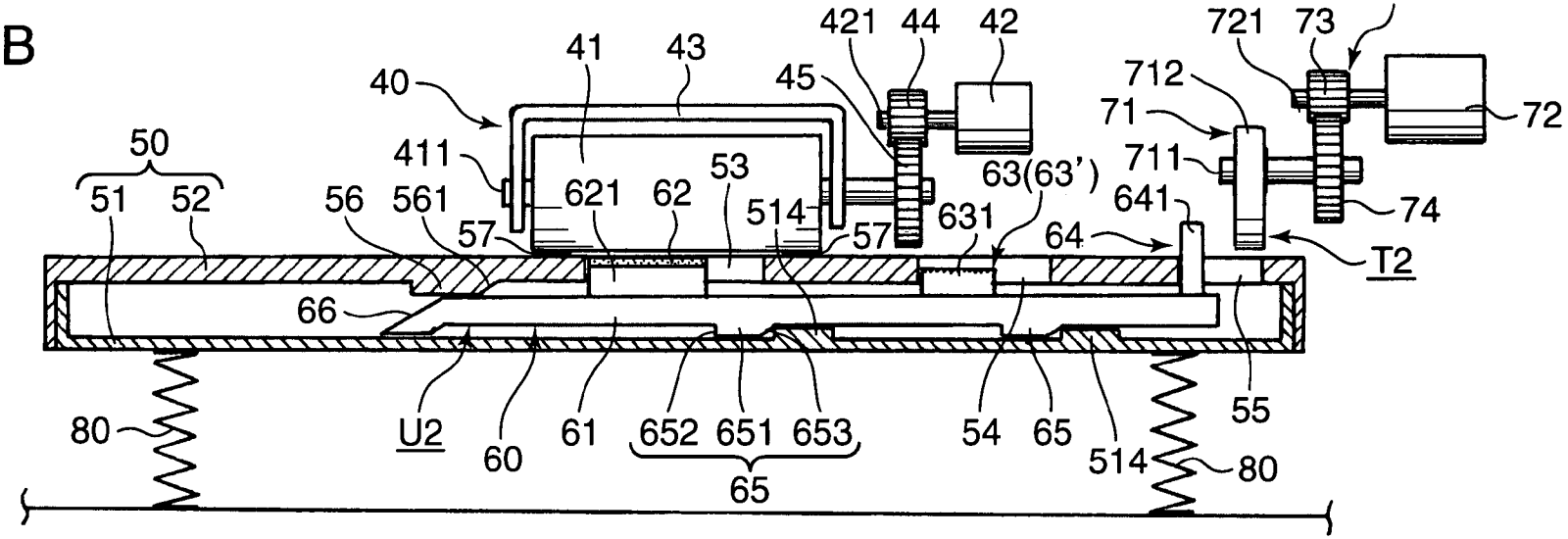

FIGS. 5A and 5B are cross-sectional views of the bottom plate 50 taken along the line V-V in FIG. 4. FIG. 5A shows a state that the first projection 62 is set to the upper position U1, which corresponds to the contact position T1 of the blocking projection 64. FIG. 5B shows a state that the first projection 62 is set to the lower position U2, which corresponds to the release position T2 of the blocking projection 64.

As shown in FIG. 5A, when the first projection 62 is set to the upper position U1, namely, when the blocking projection 64 is set to the contact position T1, the first projection 62, the switching projection 63', and the blocking projection 64 are abutted against the right walls of the first engaging opening 53, the second engaging opening 54, and the third engaging opening 55, respectively. Thereby, the elevating projections 65 climb over the respective corresponding anchor projections 514, and the contact pad 621 of the first projection 62 is projected upward through the first engaging opening 53, and the arcuate surface 641 of the blocking projection 64 is pressingly contacted with the circumferential surface 712 of the eccentric cam 71.

The contact pad 621 has such a thickness that a projected amount of the contact pad 621 through the first engaging opening 53 is set larger than the thickness of the guide pad 57.

With this arrangement, when the bottom plate 50 is set to the first position S1, the upper surface of the contact pad 621 is pressingly contacted with the outer surface of the feed roller 41 due to the urging force of the coil springs 80, with a certain clearance defined between the guide pads 57 and the feed roller 41.

When the blocking projection 64 is set to the contact position T1, the arcuate surface 641 of the blocking projection 64 is pressingly contacted with the circumferential surface 712 of the eccentric cam 71. In this state, driving the elevating motor 72 to eccentrically drive the eccentric cam 71 about the axis of the cam shaft 711 enables to pivot the bottom plate 50 up and down about the axes of the pivot pins 523, whereby a portion of the bottom plate 50 where the position changer 60 is provided is pivotally moved up and down.

In the embodiment, the sheet stack P1 is placed on the manual tray 30 in a state that the blocking projection 64 is set to the contact position T1. With this arrangement, the respective recording sheets P of the sheet stack P1 placed on the manual tray 30 are fed from an uppermost one successively toward the transferring section 13 by drivingly rotating the feed roller 41 in synchronism with the eccentric cam 71.

Then, moving the switching projection 63' leftward in a state that the switching bar 61 is set to the upper position U1 enables to disengage the elevating projections 65 from the anchor projections 514 because the switching bar 61 is moved leftward. Also, the downslope 66 of the switching bar 61 is moved downward while being guided along the upslope 561 of the guide projection 56. Thereby, as shown in FIG. 5B, the switching bar 61 is set to the lower position U2 where the contact pad 621 is received in the first engaging opening 53, and at the same time, the blocking projection 64 is set to the release position T2 where the blocking projection 64 is kept away from the eccentric cam 71.

When the switching bar 61 is set to the lower position U2, the blocking projection 64 is kept away from the eccentric cam 71. Accordingly, the bottom plate 50 is constantly urged upward by the urging force of the coil springs 80. Thereby, the pair of guide pads 57 are pressingly contacted with the outer surface of the feed roller 41.

In this embodiment, in the case where a single recording sheet P is to be fed by placing the recording sheet P on the manual tray 30, the switching bar 61 is set to the lower position U2. This allows the recording sheet P placed on the manual tray 30 to be securely guided to the clearance defined by the pair of guide pads 57 and the feed roller 41 simultaneously with the driving rotation of the feed roller 41 without an additional operation of moving the bottom plate 50 up and down. Thus, the recording sheet P can be efficiently and stably fed toward the transferring section 13.

Figure 6A:
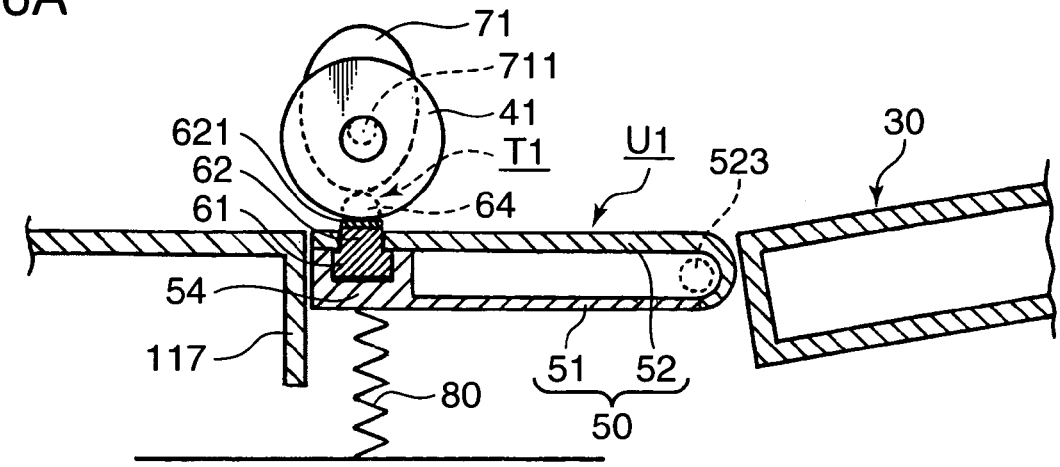
Figure 6B:
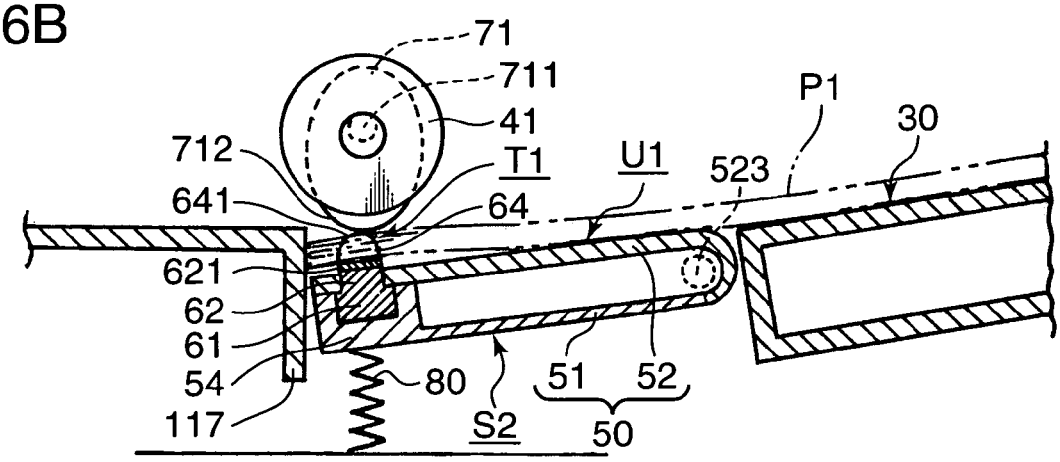
Figure 6C:
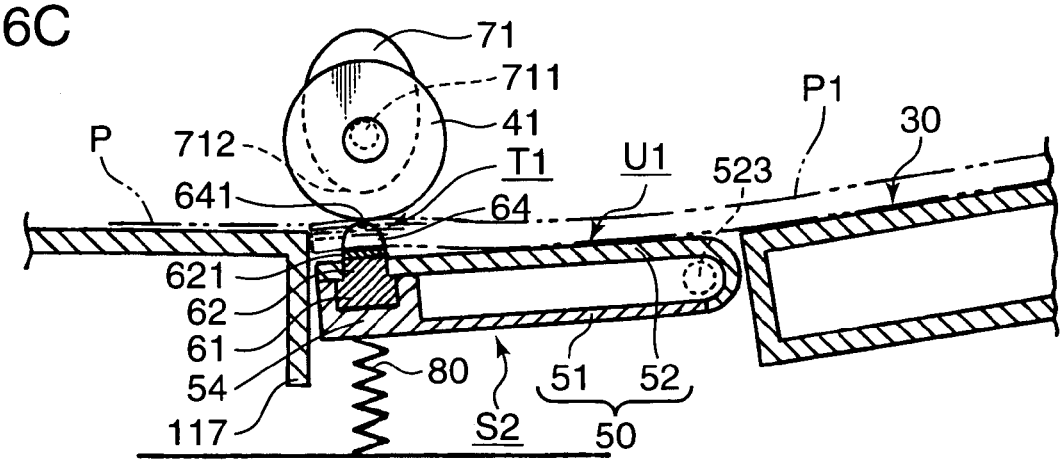

FIGS. 6A through 6C are cross-sectional views of the manual sheet feeder 20 taken along the line VI-VI in FIG. 4 to describe an operation of the manual sheet feeder 20 in the case where the sheet stack P1 is placed on the manual tray 30 in a state that the blocking projection 64 is set to the contact position T1, namely, a state that the first projection 62 is set to the upper position U1. FIG. 6A shows a state that the sheet stack P1 is not placed on the bottom plate 50 set to the upper position U1. FIG. 6B shows a state that the sheet stack P1 is placed on the bottom plate 50 set to the second position S2. FIG. 6C shows a state that a recording sheet P out of the sheet stack P1 placed on the bottom plate 50 set to the second position S2 is about to be fed toward the transferring section 13.

When the sheet stack P1 is placed on the manual tray 30, by moving the switching projection 63' rightward in FIG. 5A, the blocking projection 64 is set to the contact position T1, and the first projection 62 is set to the upper position U1, and the eccentric cam 71 and the feed roller 41 are synchronously driven, as shown in FIG. 6A.

Then, as shown in FIG. 6B, a portion of the circumferential surface 712 of the eccentric cam 71, which corresponds to a maximal eccentric length thereof, is contacted with the arcuate surface 641 of the blocking projection 64 by the driving of the eccentric cam 71, and a leading end of the sheet stack P1 is received in a nip portion between the outer surface of the feed roller 41 and the upper surface of the contact pad 621. When the leading end of the sheet stack P1 is received, the leading end of the sheet stack P1 is abutted against a stopper 117 provided immediately downstream of the bottom plate 50. Thereby, a leading end of the uppermost recording sheet P of the sheet stack P1 opposes to the outer surface of the feed roller 41.

Subsequently, when an illustrated start button of the printer 10 is depressed, the eccentric cam 71 is rotated clockwise by 180 degrees about the axis of the cam shaft 711. Then, the arcuate surface 641 of the blocking projection 64 opposes a portion of the circumferential surface 712 of the eccentric cam 71, which corresponds to a minimal eccentric length thereof. Thereby, as shown in FIG. 6C, the sheet stack P1 is pressingly held between the feed roller 41 and the contact pad 621 due to the urging force of the coil springs 80.

In the above state, the leading end of the sheet stack P1 substantially except for the uppermost recording sheet P is abutted against the stopper 117. In this state, driving the feed motor 42 (see FIG. 4) to rotate the feed roller 41 clockwise about the axis of the roller shaft 411 enables to feed the uppermost recording sheet P toward the transferring section 13.

Subsequently, when a trailing end of the uppermost recording sheet P passes the feed roller 41, the elevating motor 72 (see FIG. 4) is driven to rotate the eccentric cam 71 clockwise about the axis of the cam shaft 711. When the eccentric cam 71 is rotated by 180 degrees, the manual sheet feeder 20 is returned to the position shown in FIG. 6B.

Cyclically repeating the aforementioned associated operation of the feed roller 41 and the eccentric cam 71 by the associated driving of the feed motor 42 and the elevating motor 72 enables to feed the recording sheet P out of the sheet stack P1 one by one. Also, the bottom plate 50 is pivoted up and down about the axes of the pivot pins 523 each time the recording sheet P is fed to pivotally move the forward end of the bottom plate 50 up and down. Thus, each time the forward end of the bottom plate 50 is moved up and down, the leading end of the sheet stack P1 is aligned, thereby stably and successively feeding the uppermost recording sheet P in an aligned manner.

As described above in details, the manual sheet feeder 20 as an example of the sheet feeding device of the invention is so constructed as to feed the recording sheet P to be printed toward the transferring section 13 of the printer 10 by way of the manual tray 30. The manual sheet feeder 20 includes: the feed roller 41, which is disposed above the manual tray 30 as opposed thereto, for feeding the recording sheet P toward the transferring section 13 by driving rotation thereof about the axis of the roller shaft 411 extending in the widthwise direction of the recording sheet P; the pressing member, which corresponds to the bottom plate 50 in the embodiment, and is pivotally connected to the downstream end of the manual tray 30 for pressingly contacting the leading end of the recording sheet P with the feed roller 41; the position changer 60 for changing the position of the pressing member between the first position S1 where the pressing member is contacted with the feed roller 41, and the second position S2 where the pressing member is kept away from the feed roller 41; and the elevating mechanism 70 for moving the pressing member set to the second position S2 up and down by the position changer 60 each time the recording sheet P is fed, and for bringing the leading end of the recording sheet P into contact with the feed roller 41 when the pressing member is moved upward.

With the above construction, in automatically feeding a recording sheet P out of the sheet stack P1 placed on the manual tray 30 one by one, the position changer 60 is operated to set the pressing member to the second position S2. When the manual sheet feeder 20 is operated to feed the recording sheet P in this state, first, the feed roller 41 is drivingly rotated, and the pressing member is pivotally moved up and down by driving the elevating mechanism 70. When the pressing member is moved upward by driving the elevating mechanism, the uppermost recording sheet P of the sheet stack P1 comes into contact with the rotating feed roller 41. Accordingly, solely the uppermost recording sheet P is separated from the rest of the sheet stack P1, and fed by the feed roller 41. In synchronism with the feeding operation, the pressing member is moved downward by driving the elevating mechanism 70. Thereby, a recording sheet P to be fed next is separated from the feed roller 41, which enables to prevent a so called "multiple sheet feeding" such as feeding of a next recording sheet P during the feeding of the uppermost recording sheet P or immediately after the feeding of the uppermost recording sheet P.

Making the pivotal movement of the pressing member by the elevating mechanism 70 synchronous with a transferring operation in the transferring section 13 enables to feed the sheet stack P1 placed on the manual tray 30 one by one to the transferring section 13 as timed with a transferring operation in the transferring section 13. This allows the successive transferring operations for the respective recording sheets P.

On the other hand, in placing a single recording sheet P on the manual tray 30 to perform a transferring operation for the recording sheet P, the position changer 60 is operated to set the pressing member to the first position S1. When the pressing member is set to the first position S1, the pressing member is kept in contact with the feed roller 41. Accordingly, a leading end of the recording sheet. P placed on the manual tray 30 is immediately fed to the nip portion where the feed roller 41 and the pressing member come into contact with each other. This arrangement allows the recording sheet P to be fed readily and securely by the rotation of the feed roller 41.

As mentioned above, in feeding a single recording sheet P, the pressing member is set to the first position S1, and in feeding a recording sheet P out of the sheet stack P1 one by one, the pressing member is set to the second position S2. Thus, changing over the position of the pressing member depending on the number of the recording sheets P to be fed from the manual tray 30 enables to stably feed the recording sheet P toward the transferring section 13, irrespective of the condition as to whether the recording sheet placed on the manual tray 30 is single or multiple.

In the conventional manual sheet feeder, it is required to move the pressing member up and down irrespective of the condition as to whether the recording sheet placed on the manual tray is single or multiple. In the conventional arrangement, even if a single recording sheet is placed on the manual tray for feeding, the pressing member is moved up and down. In such a condition, the operator cannot control the feeding operation depending on the number of the recording sheets to be fed from the manual tray, not to mention lowering of the feeding efficiency, which obstructs proper feeding of the recording sheet. The invention, however, is advantageous in securely preventing occurrence of the drawback residing in the conventional art.

In the embodiment, the pressing member includes the bottom plate 50 whose position is changeable between the first position S1 and the second position S2 by a pivotal rotation thereof about the axes of the pivot pins 523 extending in the widthwise direction of the recording sheet; and the coil springs 80 for urging the bottom plate 50 toward the feed roller 41.

With this arrangement, as compared with an arrangement where the bottom plate 50 is vertically moved by parallel translation, the construction of the elevating mechanism 70 can be simplified, and the bottom plate 50 can be stably moved up and down because the bottom plate 50 pivotally changes its position between the first position S1 and the second position S2 about the axes of the pivot pins 523. Further, the bottom plate 50 presses the feed roller 41 by the urging force of the coil springs 80 when the bottom plate 50 is moved to the uppermost position. This arrangement causes the bottom plate 50 to securely contact with the feed roller 41, whereby the recording sheet P is securely fed toward the transferring section 13.

In this embodiment, the elevating mechanism 70 includes: the blocking projection 64 projecting from the bottom plate 50 toward the feed roller 41; and the eccentric cam 71 for changing over the position of the bottom plate 50 between the first position S1 and the second position S2 by a rotation thereof with the circumferential surface thereof in contact with the blocking projection 64.

With this arrangement, the bottom plate 50 can be moved up and down by way of the blocking projection 64 in accordance with the configuration of the eccentric cam 71 by rotating the eccentric cam 71. Also, the elevating mechanism 70 is constituted of the blocking projection 64 provided on the bottom plate 50, and the eccentric cam 71 whose circumferential surface is brought into contact with the blocking projection 64. This arrangement is advantageous in contributing to production cost reduction of the manual sheet feeder 20 while simplifying the construction thereof, and in securing stable pivotal rotation of the bottom plate 50.

In this embodiment, the position changer 60 includes: the switching bar 61 which has the blocking projection 64 at an end thereof, and is slidably connected to the bottom plate 50; and the switching lever 63' for changing over the position of the switching bar 61 between the contact position where the blocking projection 64 comes into contact with the circumferential surface of the eccentric cam 71, and the release position where the contact of the blocking projection 64 with the eccentric cam 71 is released.

With this arrangement, when the switching bar 61 is set to the contact position by moving the switching projection 63' in a certain direction, the blocking projection 64 of the switching bar 61 is contacted with the circumferential surface of the eccentric cam 71, whereby the position of the bottom plate 50 is changeable between the first position S1 and the second position S2. On the other hand, when the switching bar 61 is set to the release position by moving the switching projection 63' in the opposite direction, the blocking projection 64 of the switching bar 61 is away from the circumferential surface 712 of the eccentric cam 71, whereby the switching bar 61 is set to the first position S1 by the urging force of the coil springs 80.

In this way, since the position changer 60 is constituted of the switching bar 61 having the blocking projection 64, the construction of the position changer 60 can be simplified, and the position of the bottom plate 50 is changeable between the first position where a single recording sheet is to be fed, and the second position where recording sheets of a stack are fed one by one.

In this embodiment, the contact pad 621 is provided so that the recording sheet P placed on the manual tray 30 is pressingly held by the feed roller 41 and the contact pad 621. With this arrangement, the lowermost recording sheet of the sheet stack placed on the manual tray 30 comes into contact with the contact pad 621 when the switching bar 61 is set to the contact position by the position changer 60. This arrangement prevents the lowermost recording sheet P from displacing in the sheet transport direction. Accordingly, the uppermost recording sheet P out of the sheet stack P1 can be securely fed by the feed roller 41.

The invention is not limited to the foregoing embodiment, but may be modified as follows.

In the embodiment, the sheet feeding device of the invention i.e. the manual sheet feeder 20 is applied to the printer 10 as an example of an image forming apparatus. Alternatively, the sheet feeding device may be applied to other examples of the image forming apparatus such as a copying machine and a facsimile machine.

In the embodiment, the bottom plate 50 is pivotally movable up and down about the axes of the pivot pins 523 so that the leading end of the bottom plate 50 is pivotally moved up and down about the axes of the pivot pins 523. Alternatively, the bottom plate 50 may be vertically moved by parallel translation while being guided along vertically extending guide rails.

In the embodiment, the coil springs 80 are provided as urging members for urging the bottom plate 50 upward. Alternatively, a leaf spring, a spiral spring, or an elastic member such as a rubber member may be used as the urging member.

In the embodiment, the eccentric cam 71 is used as a part of the elevating mechanism 70. Alternatively, a crank mechanism, a solenoid device which is energizable by supply of an electric current, or a like device may be used in place of the eccentric cam 71.

This application is based on Japanese Patent Application No. 2005-61822 filed on Mar. 7, 2005, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet feeding device for feeding a recording sheet to a sheet transport path, the sheet feeding device comprising:

a sheet feeding tray for placing a recording sheet to be fed;

a feed roller, opposed to the sheet feeding tray for feeding the recording sheet to the sheet transport path by a driving rotation thereof about a rotation axis thereof extending in a widthwise direction of the recording sheet;

a pressing member, disposed at a downstream end of the sheet feeding tray in a sheet transport direction, the pressing member being movable between a first position where the pressing member comes into contact with the feed roller or is made close to the feed roller, and a second position where the pressing member is kept away from the feed roller by a certain clearance an urging member for urging the pressing member towards the first position;

an elevating mechanism cooperating with the urging member for moving the pressing member between the first and second positions each time the recording sheet is fed, and for bringing the leading end of the recording sheet into contact with the feed roller when the pressing member is moved towards the first position; and a position changer movably and slidably connected to the pressing member in a direction orthogonal to the sheet transport direction: wherein the position changer is movable between a contact position where the position changer is aligned for engagement by the elevating mechanism and a release position where the position changer is aligned for avoiding engagement with the elevating mechanism so that the elevating mechanism and the urging member move the pressing member between the first and second positions each time a recording sheet is fed when the position changer is in the contact position and, the urging member continuously urges the pressing member towards the first position when the position changer is in the release position.

2. The sheet feeding device according to claim 1, wherein the pressing member includes:

a bottom plate whose position is changeable between the first position and the second position by a pivotal rotation thereof about an axis of a support pin extending in the widthwise direction of the recording sheet; and wherein the urging member urges the bottom plate toward the feed roller.

3. The sheet feeding device according to claim 2, wherein the elevating mechanism includes:

a projection projecting from the bottom plate toward the feed roller; and a cam for changing over the position of the bottom plate between the first position and the second position by a rotation thereof, with a circumferential surface thereof in contact with the projection.

4. The sheet feeding device according to claim 3, wherein the position changer includes:

a slide bar having an end formed with the projection, the slide bar being slidably connected to the bottom plate; and a switching lever for changing over a position of the slide bar between the contact position where the projection comes into contact with the circumferential surface of the cam, and the release position where the contact of the projection with the circumferential surface of the cam is released.

5. The sheet feeding device according to claim 4, wherein the pressing member is constructed in such a manner that a pad member having a first frictional coefficient projects from the bottom plate when the bottom plate is set to the second position to pressingly hold the recording sheet by the feed roller and the bottom plate, and that a pad member having a second frictional coefficient smaller than the first frictional coefficient comes into contact with the recording sheet when the bottom plate is set to the first position.

6. The sheet feeding device of claim 1, wherein the position changer is movably and slidably connected to the pressing member for movement substantially parallel to the rotation axis of the feed roller.

7. An image forming apparatus comprising:

an apparatus main body having a transferring section for transferring an image on a recording sheet; and a sheet feeding device for feeding a recording sheet toward the transferring section along a sheet transport path, the sheet feeding device including:

a sheet feeding tray for placing a recording sheet to be fed;

a feed roller, opposed to the sheet feeding tray, for feeding the recording sheet to the sheet transport path by a driving rotation thereof about a rotational axis thereof extending in a widthwise direction of the recording sheet;

a pressing member disposed at a downstream end of the sheet feeding tray in a sheet transport direction to be movable between a first position where the pressing member comes into contact with the feed roller or is made close to the feed roller, and a second position where the pressing member is spaced away from the feed roller by a certain clearance an urging member for urging the pressing member towards the first position;

an elevating mechanism cooperating with the urging member for moving the pressing member between the first and second positions each time the recording sheet is fed, and for bringing the leading end of the recording sheet into contact with the feed roller when the pressing member is moved towards the first position; and a position changer movably and slidably connected to the pressing member in a direction orthogonal to the sheet transport direction; wherein the position changer is movable between a contact position where the position changer is aligned for engagement by the elevating mechanism and a release position where the position changer is aligned for avoiding engagement with the elevating mechanism so that the elevating mechanism and the urging member move the pressing member between the first and second positions each time a recording sheet is fed when the position changer is in the contact position and, the urging member continuously urges the pressing member towards the first position when the position changer is in the release position.

8. The image forming apparatus according to claim 7, wherein the pressing member includes:

a bottom plate whose position is changeable between the first position and the second position by a pivotal rotation thereof about an axis of a support pin extending in the widthwise direction of the recording sheet; and wherein the urging member urges the bottom plate toward the feed roller.

9. The image forming apparatus according to claim 8, wherein the elevating mechanism includes:

a projection projecting from the bottom plate toward the feed roller; and a cam for changing over the position of the bottom plate between the first position and the second position by a rotation thereof with a circumferential surface thereof in contact with the projection.

10. The image forming apparatus according to claim 9, wherein the position changer includes:

a slide bar having an end formed with the projection, the slide bar being slidably connected to the bottom plate; and a switching lever for changing over a position of the slide bar between the contact position where the projection comes into contact with the circumferential surface of the cam, and the release position where the contact of the projection with the circumferential surface of the cam is released.

11. The image forming apparatus according to claim 10, wherein the pressing member is constructed in such a manner that a pad member having a first frictional coefficient projects from the plate when the bottom plate is set to the second position to pressingly hold the recording sheet by the feed roller and the bottom plate, and that a pad member having a second frictional coefficient smaller than the first frictional coefficient comes into contact with the recording sheet when the bottom plate is set to the first position.

12. The image forming apparatus of claim 7, wherein the position changer is movably and slidably connected to the pressing member for movement substantially parallel to the rotation axis of the feed roller.

13. A sheet feeding device for feeding a recording sheet to a sheet transport path, the sheet feeding device comprising:

a sheet feeding tray for placing a recording sheet to be fed;

a feed roller, opposed to the sheet feeding tray for feeding the recording sheet to the sheet transport path by a driving rotation thereof about a rotation axis thereof extending in a widthwise direction of the recording sheet;

a pressing member, disposed at a downstream end of the sheet feeding tray in a sheet transport direction, the pressing member being movable between a first position where the pressing member comes into contact with the feed roller or is made close to the feed roller, and a second position where the pressing member is kept away from the feed roller by a certain clearance, the pressing member including a bottom plate whose position is changeable between the first position and the second position by a pivotal rotation thereof about an axis of a support pin extending in the widthwise direction of the recording sheet;

an urging member for urging the pressing member toward the first position;

an elevating mechanism cooperating with the urging member for moving the pressing member between the first and second positions each time the recording sheet is fed, and for bringing the leading end of the recording sheet into contact with the feed roller when the pressing member is moved toward the first position, the elevating mechanism including a projection projecting from the bottom plate toward the feed roller, a cam for changing over the position of the bottom plate between the first position and the second position by a rotation thereof, with a circumferential surface thereof in contact with the projection; and a position changer movably connected to the pressing member for movement between a contact position where the position changer is aligned for engagement by the elevating mechanism and a release position where the position changer is aligned for avoiding engagement with the elevating mechanism so that the elevating mechanism and the urging member move the pressing member between the first and second positions each time a recording sheet is fed when the position changer is in the contact position and so that the urging member continuously urges the pressing member toward the first position when the position changer is in the release position, the position changer including a slide bar having an end formed with the projection, the slide bar being slidably connected to the bottom plate, and a switching lever for changing over a position of the slide bar between the contact position where the projection comes into contact with the circumferential surface of the cam, and the release position where the contact of the projection with the circumferential surface of the cam is released.

14. The sheet feeding device according to claim 13, wherein the pressing member is constructed in such a manner that a pad member having a first frictional coefficient projects from the bottom plate when the bottom plate is set to the second position to pressingly hold the recording sheet by the feed roller and the bottom plate, and that a pad member having a second frictional coefficient smaller than the first frictional coefficient comes into contact with the recording sheet when the bottom plate is set to the first position.

* * * * *